US006419596B1

(12) United States Patent
Dadbeh

(10) Patent No.: US 6,419,596 B1
(45) Date of Patent: Jul. 16, 2002

(54) PORTABLE BASKETBALL APPARATUS

(76) Inventor: Bemanali H. Dadbeh, 1429 Calle Cristopher, Encinitas, CA (US) 92024

( * ) Notice: Subject to any disclaimer, the term of this patent is extended or adjusted under 35 U.S.C. 154(b) by 0 days.

(21) Appl. No.: 09/250,915

(22) Filed: Feb. 16, 1999

(51) Int. Cl.[7] ..... A63B 63/08
(52) U.S. Cl. ..... 473/481; 473/472
(58) Field of Search ..... 473/481, 416, 473/480, 472

(56) References Cited

U.S. PATENT DOCUMENTS

| | | | | | |
|---|---|---|---|---|---|
| 919,807 | A | * | 4/1909 | Bailey | 52/149 |
| 925,174 | A | * | 6/1909 | Haight | 52/151 |
| 959,286 | A | * | 5/1910 | Bailey | 52/158 |
| 1,249,848 | A | * | 12/1917 | Sprauge | 52/150 |
| 1,309,806 | A | * | 7/1919 | Medart | 473/481 |
| 2,977,118 | A | * | 3/1961 | Farkas | 482/35 |
| 3,076,532 | A | * | 2/1963 | Frye | 52/157 |
| 3,170,663 | A | * | 2/1965 | Fite | 248/49 |
| 3,341,197 | A | * | 9/1967 | Bottorff | 473/483 |
| 3,716,234 | A | * | 2/1973 | Lancellotti | 473/481 |
| 4,083,561 | A | * | 4/1978 | Daffer | 473/432 |
| 4,869,501 | A | * | 9/1989 | Anastasakis | 473/483 |
| 5,300,920 | A | * | 4/1994 | Caselli et al. | 473/480 |
| 5,865,691 | A | * | 2/1999 | Chen | 473/416 |

* cited by examiner

*Primary Examiner*—Paul T. Sewell
*Assistant Examiner*—M. Chambers
(74) *Attorney, Agent, or Firm*—Irving Keschner

(57) ABSTRACT

A portable basketball unit comprising a hoop, backboard and pole having a base portion. The base portion is modified so that a brace system can be secured thereto. Auger screws are secured to the brace system and driven into the ground. The base unit is attached to the auger screws and a leveling collar and adjustment leveler is used to cause the pole to be substantially vertical. The attachment members are then tightened and the middle and upper portions are attached, the basketball unit being ready for play.

1 Claim, 4 Drawing Sheets

PORTABLE BASKETBALL APPARATUS

BACKGROUND OF THE INVENTION

1. Field of the Invention

The present invention relates to a portable basketball apparatus which is relatively simple in construction, easy to securely mount at a selected location and easy to move when desired.

2. Description of the Prior Art

The game of basketball is a popular game in the United States, as well as in many parts of the world. The game is played at home, elementary schools, high schools, colleges and universities and finally by professional teams. The apparatus consists of a ring or hoop of a certain diameter, mounted on a board and means for holding the unit a certain height above the ground. The official height is 10 feet from the ground level to the rim of the hoop. A basketball of predetermined diameter is used in play.

The interest in the game starts at an early age. Typically, parents provide their children with equipment at home in the following ways:

(1) The board and goal is mounted to the wall or above the garage door, support braces being typically anchored to the roof of the house to support the board and goal. Most homeowners associations reject this arrangement due to unsightliness; in addition, this configuration can cause damage to the house and cause roof leakage.

(2) A pole is permanently placed in the ground using concrete. This requires digging a large hole, mixing concrete, holding the pole in place and pouring concrete around it and holding the pole straight until the concrete sets. If the user is not happy with the location of the pole or wants to move to a new home, the choice is to leave or destroy the pole.

To cope with the problems noted hereinabove, the portable basketball unit was designed. In this case, the pole is mounted on a base consisting of a large tank, the tank being filled with about 400 pounds or more of water or sand to provide stability. Two or more wheels are provided to move the unit around. The unit thus can be moved to the driveway, walkway or streets. About 70% of the basketball units sold are portables. However, many problems are associated with the portable basketball unit. Specifically:

(1) The unit is vulnerable to gusts of wind and can unpredictably tip over, causing unsafe and dangerous conditions.

(2) It is more convenient to fill the tank with water rather than sand. However, many of the water tanks develop leaks. If this condition is not detected in time, the unit could fall over, causing injury or even death.

(3) The backboard acts as a sail and thus wind can push the unit from the driveway into the street or tip it over, causing unsafe conditions.

(4) If the unit is placed in the street, children get so involved in the game that they ignore oncoming cars and traffic, thus hurting themselves or others.

(5) Due to the difficulty and awkwardness of moving a heavy unit around, the unit may be left in the street after the game causing unsafe conditions. In this regard, some governmental units approved ordinances that in effect requires residents to keep portable basketball units off streets and sidewalks at night, violators being subject to fines. To avoid litigation, homeowners associations and city governments are working to find a way to cope with these problems.

What is desired therefor is to provide a portable basketball unit which is safe, lightweight and economical and which avoids the problems noted hereinabove.

SUMMARY OF THE PRESENT INVENTION

The present invention provides a basketball unit, or apparatus, in which a safe and suitable location, can be selected, the unit then assembled and mounted in place in a short time. The unit can be moved to a different location at will, the pole and board being easily removed and stored. The unit does not require weights, water tanks or concrete. The apparatus of the present invention is safe, will not tip over in the wind, is easily disassembled and stored and easily remounted for play. At the end of the day, the unit is removed again and returned to storage, such as in a home garage.

The unit comprises a conventional hoop and backboard. The pole is modified at the base portion thereof to the extent that an external brace system can be secured thereto. Auger screws are secured to the brace system and driven into the ground. The base unit is attached to the auger screws and a leveling collar and adjustment leveler is used to cause the pole to be substantially vertical. The attachment members are then tightened and the middle and upper portions of the pole are attached, the basketball unit being ready for play.

The present invention thus provides a simple, lightweight economical and safe portable basketball unit whereby the unit is secured at a designated area of the ground.

DESCRIPTION OF THE DRAWINGS

For a better understanding of the invention as well as other objects and further features thereof, reference is made to the following description which is to be read in conjunction with the accompanying drawing wherein.

DESCRIPTION OF THE INVENTION

Figure 1:
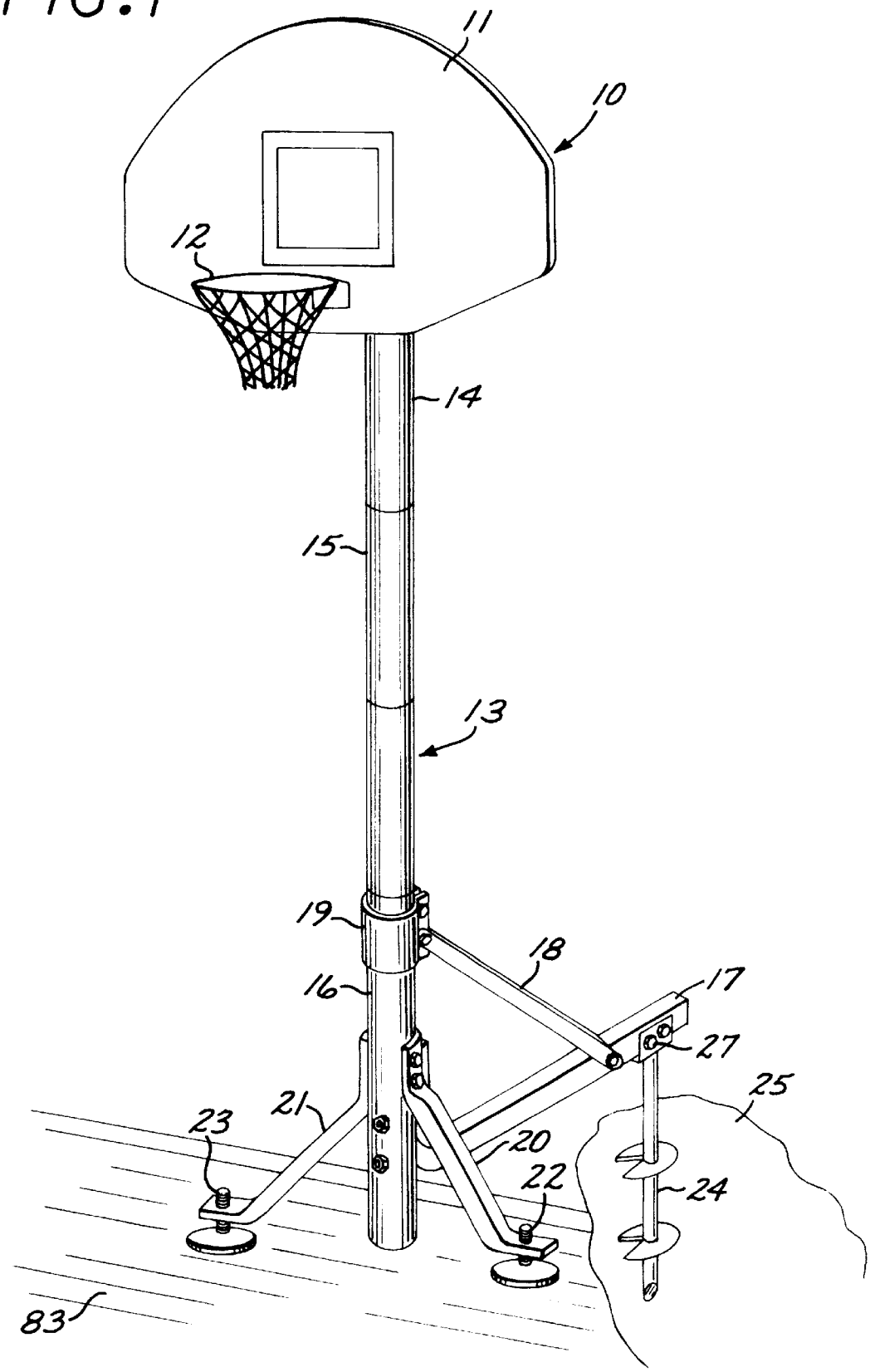
FIG. 1 shows a perspective view of the basketball apparatus of the present invention with a single attachment to the ground.
Figure 2:
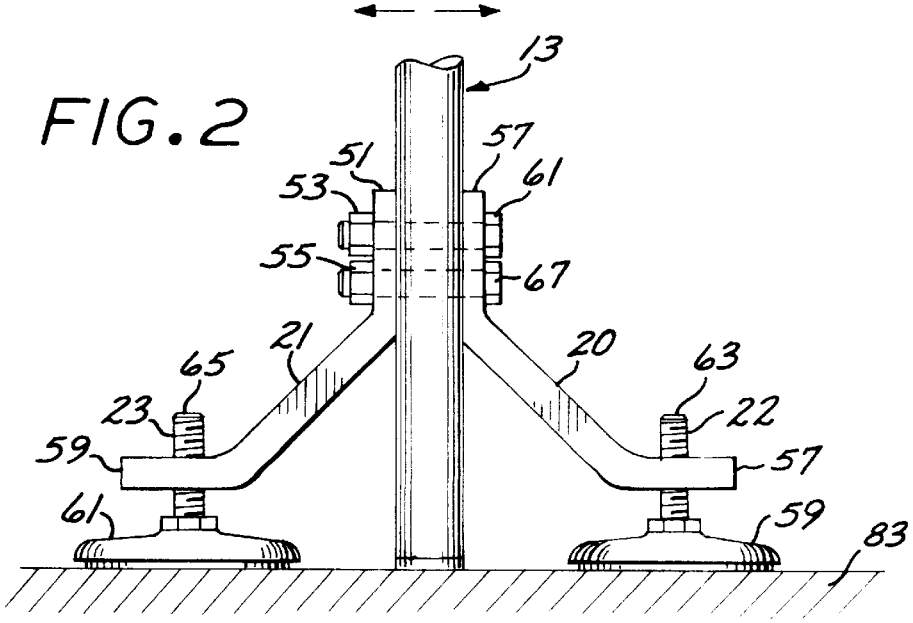
FIG. 2 shows a detail view of the front of the pole shown in FIG. 1 with side to side supports and side to side vertical adjustment levelers.

Referring now to FIG. 1, the new in-ground portable basketball unit 10 of the present invention is illustrated. Unit 10 comprises basketball backboard 11 and hoop 12 mounted on pole 13. Pole 13 comprises upper portion 14, middle portion 15 and base portion 16, all interconnected by a wedge and bolt or other means (pole 13 could comprise fewer or a greater number of sections, dependent on the size of the unit packaging). Ground auger screw 24 is placed in the ground 25 and is attached to horizontal support 17 by a pin, bolt, or other means 27. The horizontal support 17 is bolted to the base pole 16, which rests on a solid surface such as concrete, bricks or a metal element. The pole is vertically supported by diagonal support brace 18. One end of diagonal brace 18 is bolted to horizontal support 17, the other end attached to the front to back adjustment collar member 19. By loosening the collar member 19 and moving it up or down along pole 13, pole 13 will be caused to move forward or backward. The base pole portion 16 also is supported with two side to side supports 20 and 21. Provided at one end of supports 20 and 21 are side to side vertical adjustment levelers 22 and 23 to accomodate the unevenness of surface area 83, such as a driveway. Raising or lowering either or both of the adjustment levelers 22 and 23 will cause the pole base 16 to move angularly to left or right. The other side of supports 20 and 21 are connected to pole 13 via fasteners 53 and 55 (FIG 2). Adjustment collar 19 and adjustment levelers 22 and 23 are used to adjust pole 13 such that it stands substantially vertically level.

FIG. 2 illustrates the front of pole 13 and, in particular, the connection of supports 20 and 21 to levelers 22 and 23, respectively, and pole 13. The ends of supports 20 and 21 are connected to pole 13 via fasteners 53 and 55 connected through aligned apertures formed in portions 51 and 57 of supports 20 and 21, respectively, and nuts 61 and 67. Side supports 20 and 21 further include horizontal portions 57 and 59, respectively, having apertures formed therein. Levelers 22 and 23 comprise foot pads 59 and 61, respectively, and threaded members 63 and 65 secured to foot pads 59 and 61, respectively.

Figure 3:
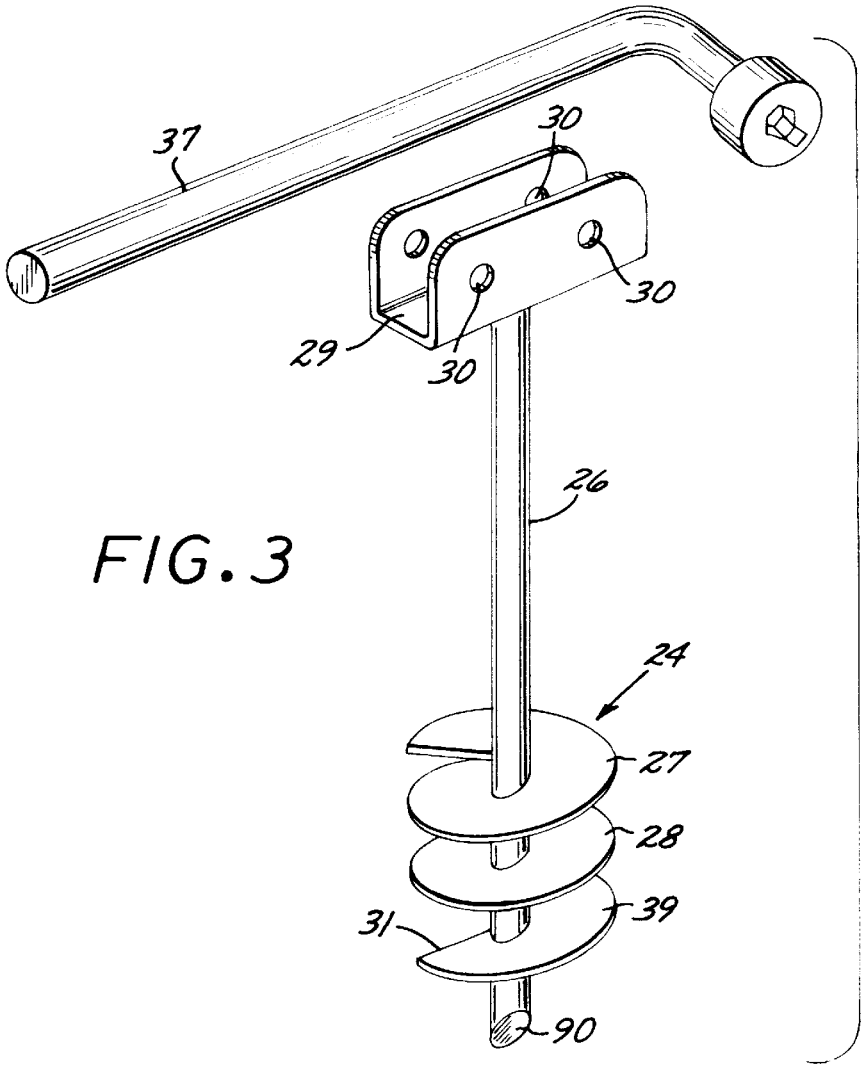
FIG. 3 shows a detail of an auger screw used to secure the unit to the ground.

FIG. 3 illustrates a detail of the auger screw 24. In particular, the auger screw is a weldment consisting of rod 26 with sufficient diameter and length, drive blades 27, 28 and 39 which are configured similar to a tapered helical screw with the top blade 27 diameter being greater than the diameter of blade 28, the diameter of blade 28 in turn being greater than the diameter of blade 39, drive edge 31 angling downward for ease of penetration, and top channel 29 to cradle the horizontal supports 17, 31, 32 (FIG. 4) or 33 (FIG. 5) and holes 30 to accommodate attachment to the horizontal supports by appropriate fasteners. The tip 90 of rod 26 is preferably cut at an angle to facilitate drilling of the hole. A tire wrench or crowbar 37 is used to drive the auger screw into the ground. Auger screw 24 is designed to have substantial strength so that when driven into the ground, substantial resistance and holddown power is provided. It should be noted that other devices can be used to secure pole 13 to the ground.

Figure 4:
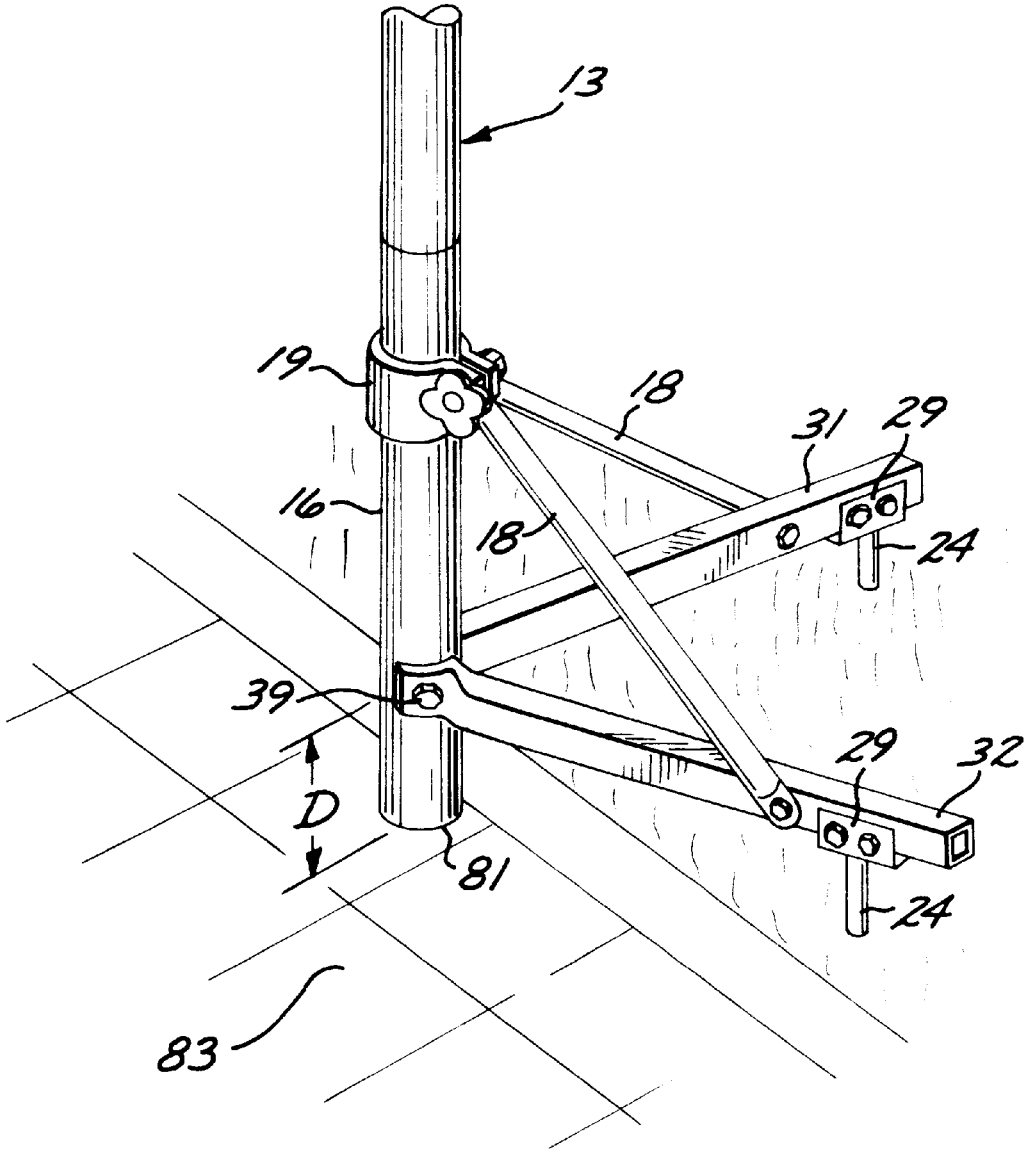
FIG. 4 shows a basketball apparatus of the present invention with two attachments to the ground.

FIG. 4 illustrates a second embodiment of the invention using two ground auger screws 24. The auger screws are driven to ground until the auger heads 29 and bolt attachment 39 are substantially level, the auger heads then forming a horizontal plane making it easier to set the pole 13 in a direction substantially perpendicular to the formed plane. In essence, the two horizontal supports 31 and 32 attached to the base unit 16 with bolt 39 form an angular shape and provide further support to pole 13.

Figure 5:
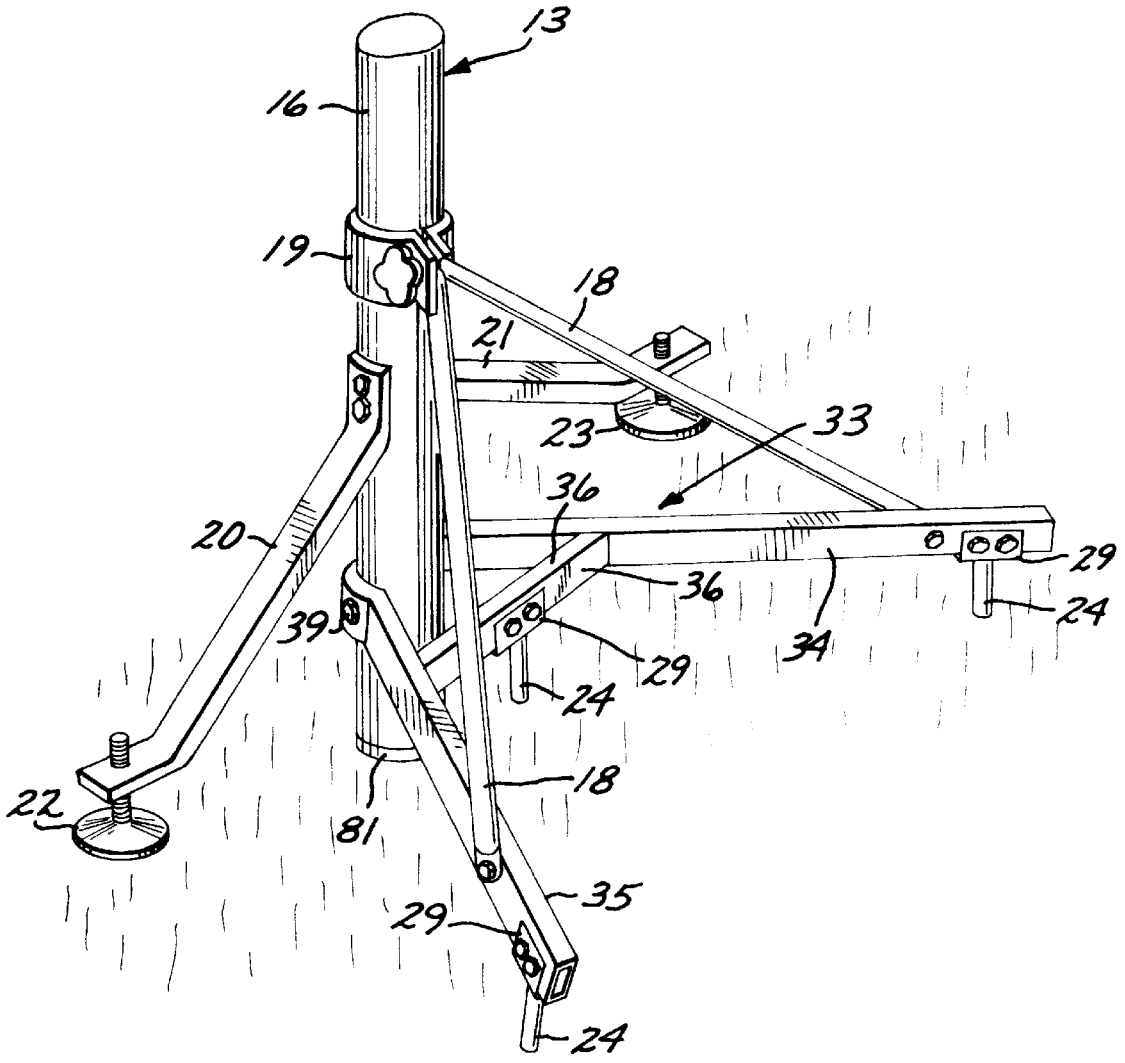
FIG. 5 shows a heavy duty basketball apparatus with three attachments to the ground.

FIG. 5 illustrates a third embodiment of the invention using three ground auger screws 24. The horizontal support for pole 13 is a weldment 33 consisting of members 34, 35 and 36 forming an angular shape. Weldment 33 is attached to base pole 16 with bolt 39. In this unit the auger screws 24 are driven until the three auger heads 29 and bolt 39 are at a substantially horizontal level for the reasons noted hereinabove.

The base units consisting of base pole 16, horizontal supports 17, or 31, 32 or 33 and diagonal supports 18 and adjustment collar 19 and side to side supports 20, 21 and adjustment levelers 22 and 23 are assembled, attachment bolt 39 being placed a distance "D" above base pole end 81 (illustrated in the FIG. 4 embodiment although the same provision is used for the FIG. 5 embodiment) to avoid garden edges.

A suitable area close to or in a garden area, large enough to play the game is preferably utilized. A hard surface area 83 is provided to support the end of the base pole 81 and the adjustment levelers 22 and 23 (if in a garden a piece of plywood or other means can be used). Using a templet or the base unit 16 itself, the auger screws, are marked and driven in using the tire wrench or crowbar 37. The base unit 16 is then attached to the auger screws 24. The leveling collar 19 and adjustment leveler 22 and 23 are adjusted to hold the pole 13 substantially vertical and all attachments are then tightened, the final assembly step of inserting other sections is then accomplished, the portable basketball apparatus 10 now being ready for play.

The present invention thus provides a simple, safe and cost efficient portable basketball unit which overcomes the disadvantages in portable basketball units currently available.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A portable basketball apparatus comprising:

a backboard;

a hoop coupled to said backboard;

an elongated pole comprising first and second portions, said first and second pole portions being interconnected, said second pole portion having a bottom surface;

a first support member having first and second ends, one end of said first support member being connected to said second pole portion;

an attachment member having first and second ends, said first end of said attachment member being secured to said second end of said first support member, said second end of said attachment member being secured to the ground;

a movable collar member coupled to said second pole portion;

a brace member having one end secured to said first support member, the other end of said brace member being coupled to said collar member, movement of said collar member along said second pole portion adjusting the angular position of said elongated pole;

a second support member having first and second ends, said first end of said second support member being coupled to said second portion of said pole, and a leveler member for adjusting the angular position of said elongated pole, said second end of said second support member being coupled to said leveler member;

a third support member having first and second ends, said first end of said third support member being coupled to said second pole portion, said second end of said third support member being secured to the ground; and a fourth support member having first and second end portions and a middle portion, said first end portion of said fourth support member being coupled to said first support member, said second end portion of said fourth support member being coupled to said third support member and said middle portion of said fourth support member being secured to the ground.

* * * * *